US005200037A

United States Patent [19]

Noda

[11] Patent Number: 5,200,037

[45] Date of Patent: Apr. 6, 1993

[54] ABSORBENT STRUCTURES FROM MIXED FURNISHES

[75] Inventor: Isao Noda, Cincinnati, Ohio

[73] Assignee: The Procter & Gamble Company, Cincinnati, Ohio

[21] Appl. No.: 902,419

[22] Filed: Jun. 19, 1992

Related U.S. Application Data

[63] Continuation of Ser. No. 794,313, Jan. 14, 1991, abandoned, which is a continuation of Ser. No. 666,474, Mar. 6, 1991, abandoned, which is a continuation of Ser. No. 499,197, Mar. 23, 1990, abandoned, which is a continuation of Ser. No. 197,180, May 23, 1988, abandoned.

[51] Int. Cl.[5] ..... D21H 17/45

[52] U.S. Cl. ..... 162/168.2; 162/169; 162/183

[58] Field of Search ..... 162/168.1, 168.2, 169, 162/183, 111, 112, 141, 182

[56] References Cited

U.S. PATENT DOCUMENTS

| | | | |
|---|---|---|---|
| 2,745,744 | 5/1956 | Weidner et al. | 162/168 |
| 3,556,932 | 1/1971 | Coscia et al. | 162/166 |
| 3,556,933 | 1/1971 | Williams et al. | 162/167 |
| 3,575,913 | 4/1971 | Meier | 260/29.7 |
| 3,580,880 | 5/1971 | Clarke et al. | 260/29.6 |
| 3,700,623 | 10/1972 | Keim | 260/80.3 |
| 3,772,076 | 11/1973 | Keim | 117/155 |
| 3,812,000 | 5/1974 | Salvucci et al. | 162/111 |
| 3,926,890 | 12/1975 | Huang et al. | 260/29.6 |
| 3,965,032 | 6/1976 | Gibbs et al. | 252/306 |
| 3,998,690 | 12/1976 | Lyness et al. | 162/183 |
| 4,026,962 | 5/1977 | Lambla et al. | 260/827 |
| 4,058,124 | 11/1977 | Yen et al. | 128/284 |
| 4,121,966 | 10/1978 | Amano et al. | 162/164 |
| 4,189,345 | 2/1980 | Foster et al. | 162/168 |
| 4,279,798 | 7/1981 | Aggerwal et al. | 260/33.4 |
| 4,325,856 | 4/1982 | Ishikawa et al. | 523/201 |
| 4,385,164 | 5/1983 | Sinclair et al. | 526/201 |
| 4,504,618 | 3/1985 | Irvine et al. | 524/457 |
| 4,537,911 | 8/1985 | Chonde | 521/28 |
| 4,567,099 | 1/1986 | Van Gilder et al. | 428/327 |
| 4,734,445 | 3/1988 | Noda et al. | 523/201 |

FOREIGN PATENT DOCUMENTS

| | | |
|---|---|---|
| 33988 | 8/1981 | European Pat. Off. . |

*Primary Examiner*—Peter Chin
*Attorney, Agent, or Firm*—Jerry J. Yetter

[57] ABSTRACT

Absorbent structures such as tissues, towels, wipes, and the like, are prepared from mixed furnishes. One furnish comprises a typical pulp slurry, whereas the second furnish is treated with a latex material. Particular types of surface-hydrophilic latexes, both cationic and nonionic, are disclosed for use with the second furnish. The resulting paper articles are characterized by their improved feel, strength and absorbency.

1 Claim, No Drawings

ABSORBENT STRUCTURES FROM MIXED FURNISHES

This is a continuation of application Ser. No. 794,313, filed on Nov. 14, 1991, which is a continuation of application Ser. No. 666,474, filed on Mar. 6, 1991 which is a continuation of application Ser. No. 499,197, filed on Mar. 23, 1990 which is a continuation of application Ser. No. 197,180, filed on May 23, 1988, all now abandoned.

TECHNICAL FIELD

The present invention relates to the manufacture of absorbent structures such as disposable paper towels, wipes, tissues, and the like, from mixed furnishes, one of which is treated with latex.

BACKGROUND OF THE INVENTION

There has been a continuing effort to prepare paper with improved physical properties. In particular, "cloth-like" properties of softness, absorbency, (particularly of aqueous fluids) and strength, particularly strength when wet. Softness is the tactile sensation perceived when the consumer holds the product, rubs it across the skin, or crumples it with the hand. This tactile sensation can be related to the stiffness of the paper product. Absorbency is a measure of the ability of the product to absorb quantities of liquid, particularly aqueous fluids or dispersions. Strength is the ability of the product to maintain physical integrity, and to resist tearing, bursting and shredding under use conditions, particularly when wet. Research and development efforts have been directed to improvement of each of these properties without adversely affecting the others, as well as improvement of two or three of these properties simultaneously.

Water-soluble cationic resins are often used as wet-strength additives in paper making. One such group of wet-strength additives are the polyamideepichlorohydrin resins sold under the trade name Kymene. See, for example, U.S. Pat. No. 3,700,623 to Keim issued Oct. 24, 1972; and U.S. Pat. No. 3,772,076 to Keim, issued Nov. 13, 1973. Another group of water-soluble cationic wet-strength resins are the polyacrylamides sold under the trade name Parez See, for example, U.S. Pat. No. 3,556,932 to Coscia et al, issued Jan. 19, 1971; and U.S. Pat. No. 3,556,933 to Williams et al issued Jan. 19, 1971.

The cellulosic fibers used in papermaking are negatively charged. Since the water-soluble wet-strength resins are cationic (positively charged), they are deposited and retained well when directly added to the aqueous pulp slurry. Such "wet-end addition" is highly desirable in papermaking. Subsequently in the papermaking process, these resins cross-link and eventually become insoluble in water. When this occurs, the wet-strength resin acts as a "glue" to hold the fibers of the paper together. This results in the desired wet-strength property.

Paper products made with such resins generally have a stiff, paper-like feel. To impart greater softness to the paper product, soft rubbery latexes can be used as the binder system. However, these latexes are either nonionic in character or else are partially anionic due to inclusion of anionic comonomers or surfactants. The nonionic latexes cannot be used as "wet-end additives" in a conventional papermaking process. Instead, these nonionic latexes have to be impregnated or pattern-printed on the subsequently laid paper furnish, such as by the process described in European Patent Application 33,988 to Graves et al, published Aug. 19, 1981.

An anionic latex can be used in a conventional wet-end additive papermaking process by adding a cationic polyelectrolyte. See, for example, U.S. Pat. No. 4,121,966 to Amano et al, issued Oct. 24, 1978; and U.S. Pat. No. 2,745,744 to Weidner et al, issued May 15, 1956. The cationic polyelectrolyte used is typically a water-soluble cationic wet-strength resin. Basically, the cationic polyelectrolyte, when added, destabilizes the dispersed anionic latex particles which then flocculate and deposit on the paper fibers. Accordingly, the cationic polyelectrolyte and anionic styrene-butadiene latex cannot be combined together until the point at which they are used as the binder system in papermaking.

Latexes have also been modified to provide cationic groups chemically bound on the surface of the latex particles. See, for example, U.S. Pat. No. 4,189,345 to Foster et al, issued Feb. 19, 1980; and U.S. Pat. No. 3,926,890 to Huang et al, issued Dec. 16, 1975. Incorporation of the cationic groups on the surface of the latex particles converts the latex into a wet-end additive like the water-soluble cationic wet-strength resins. These cationic latexes appear to have adequate colloidal stability, especially when nonionic or preferably cationic surfactants are added. However, the deposition and retention of the cationic latex particles on the paper fibers does not appear to be very great. Indeed, the cationic latex of the Foster et al patent appears to require a co-additive to enhance the deposition of the latex particles on the paper fibers.

BACKGROUND ART

A. Cationic Latexes Having Particles with Styrene-Butadiene Core and Cationic Groups Chemically Bound on Surface U.S. Pat. No. 4,189,345 to Foster et al, issued Feb. 19, 1980, describes a fibrous product containing papermaking pulp, a structured-particle latex having pH independent cationic groups bound at or near the particle surface and a co-additive.

U.S. Pat. No. 3,926,890 to Huang et al, issued Dec. 16, 1975, discloses a process for preparing a "stable" cationic latex which is described as having "excellent adsorption" (only about 69% absorption of latex based on Example 5) onto substrates such as pulp, paper and the like.

B. Use of Cationic Polyelectrolytes to Enhance the Deposition of Anionic Styrene-Butadiene Latex Binder Systems on Paper Fibers U.S. Pat. 4,121,966 to Amano et al, issued Oct. 24, 1978, discloses a method for producing a fibrous sheet bonded with a latex flocculate. In this method, zinc white powders are added to a carboxy modified anionic latex. The pH of this mixture is adjusted to not less than 7, and then a water-soluble cationic polymer is added to obtain a latex flocculate. The latex flocculate is added to a fiber slurry which is formed into a sheet by a conventional papermaking process.

U.S. Pat. 2,745,744 to Weidner et al, issued May 15, 1956, discloses a method for incorporating polymeric or rubberlike materials into cellulosic fibers used to make paper. In this method, a colloidal dispersion of a hydrophobic polymer, such as a butadiene-styrene latex, is mixed with a paper pulp suspended in water. A poly-N-basic organic compound is then added to this mixture to cause particles of the colloidal dispersed material to adhere to the cellulosic fibers in the water suspension. The slurry is made into paper.

C. Polybutadiene-polyethylene oxide (PBD-PEO) diblock co-oligomers

U.S. Pat. 4,279,798 to Aggerwal et al, discloses PBD-PEO block copolymers of low molecular weight, e.g. 4000 M.W. The diblock is formed by preparing a hydroxy terminated polybutadiene prepolymer using an organolithium initiator, with subsequent addition of ethylene oxide using a double metal cyanide catalyst. These PBD-PEO diblocks are disclosed to be useful as dispersants for crude oil/alcohol mixtures. See also U.S. Pat. No. 3,978,160 to Seiler et al, issued Aug. 31, 1976, which discloses low molecular weight PBD-PEO diblocks (e.g. 3600 M.W.) suitable as anti-static agents, emulsifiers, surfactants and finishing agents for paper and textiles.

D. Aqueous polymer dispersions prepared using amphiphilic diblock copolymers

U.S. Pat. No. 4,385,164 to Sinclair et al, issued May 24, 1983, discloses aqueous dispersion polymerization of an unsaturated monomer such as butadiene in the presence of a block copolymer dispersion stabilizer.

E. Dispersion polymerization using amphiphilic diblock copolymer

U.S. Pat. No. 4,026,962 to Lambia et al, issued May 31, 1977, discloses a process for dispersion-polymerization of vinyl monomers (e.g., styrene) in water using a block copolymer of the A-B type wherein A represents a hydrophobic block and B represents a hydrophilic block. This process provides beads or balls of the desired polymer having very regular size distribution. See also U.S. Pat. No. 3,580,880 to Clarke, issued May 25, 1971, which discloses stable dispersions of polymer particles prepared by polymerizing an olefin type monomer in a liquid (e.g., water) in the presence of an amphiphatic stabilizer which associates with and stabilizes the dispersion of polymer particles formed.

F. Aqueous latexes formed by emulsion polymerization using a seed latex

U.S. Pat. No. 3,397,165 to Goodman et al, issued Aug. 13, 1968, discloses the preparation of butadiene polymer latexes useful as paper impregnants or for coating surfaces. These latexes are formed by providing a butadiene/styrene copolymer seed and then polymerizing butadiene and styrene monomers together with acrylic or methacrylic acid.

G. Aqueous latexes formed by emulsion polymerization using "shot growth" technique U.S. Pat. No. 3,575,913 to Meier, issued Apr. 20, 1971, discloses a latex especially adapted for paper coating. This latex is formed by polymerizing a monomeric composition containing an unsaturated dicarboxylic acid (itacanoic acid), a vinyl aromatic (styrene), and a conjugated diene (butadiene). After at least 90% of the monomeric composition is polymerized, 1-5% of an acrylic acid monomer is added and then polymerization is continued.

Unfortunately, the use of latexes in the preparation of modified paper-type materials can be difficult. In particular, the latex can cause "clumping" in the aqueous cellulose furnish. Clumping results in uneven distribution of the latex onto the fibers, and also results in manufacturing delays.

Moreover, if all fibers in the furnish are latex-coated, the water absorbency of the paper is decreased.

The present invention provides a process whereby "mixed" furnishes overcome these problems and provide improved paper and nonwoven structures.

SUMMARY OF THE INVENTION

The present invention relates to latex-treated absorbent structures characterized by their variably-optimizable wet-strength and improved wicking properties. The structures herein comprise an intimate, wet-laid admixture of separately-prepared pulp components A and B, wherein said pulp components comprise:

A. from about 10% to about 50% (preferably 20–40%) by weight of said structure of latex-treated fibrous pulp; and B. from about 50% to about 90% (preferably 60–80%) by weight of said structure of wicking fibrous pulp.

The latex used to prepare pulp (A) is, preferably, a latex emulsion wherein the latex particles are in the 0.1–2.5 micrometer size range. Such latexes can be hydrophobic or surface-hydrophilic latex particles, especially the latexes having outer surfaces comprising cationic hydrophilic substituents (preferred), nonionic hydrophilic substituents, or mixtures thereof, described more fully hereinafter.

For most purposes, pulp (A) and wicking pulp (B) comprise cellulosic fibers, and the structures provided by this invention are provided in the form of disposable facial tissues, disposable paper towels, nonwoven fabrics, disposable diaper topsheets, diaper core overwraps, or the like.

The invention also encompasses a process for preparing an absorbent structure, comprising:

i) admixing fibrous pulp with a latex (including surface-hydrophilic latexes) emulsion to provide latex-treated fibers (A);

ii) separately preparing wicking fibrous pulp (B);

iii) admixing pulp (A) with pulp (B) in an aqueous medium to form a mixed furnish (C); and iv) wet-laying said mixed furnish (C) and drying said furnish to form an absorbent structure.

In one aspect of the process herein, the latex-treated pulp (A) is dried prior to mixing with pulp (B), whereby said latex is firmly adhered to the fibers of pulp (A). When the latex particles have outer surfaces comprising cationic hydrophilic substituents, said particles self-adhere to the fibers of pulp (A) without a drying step. This is particularly effective when the pulp is cellulosic and, in this aspect of the invention, the drying/adherence step can be omitted.

The invention also encompasses the pulps, per se, which can be prepared in the manner disclosed herein.

DETAILED DESCRIPTION OF THE INVENTION

The present invention employs latexes to prepare a first papermaking-type aqueous furnish, and then combines the latex-treated fibers from said first furnish with a second furnish which comprises a wicking fibrous pulp to form a mixed furnish which is converted into absorbent structures using standard papermaking processes.

A. Definitions

As used herein, the term "hydrophilic" refers to materials which are substantially wetted by water.

As used herein, the term "hydrophobic" refers to materials which are substantially non-wetted by water.

As used herein, the term "elastomeric" refers to materials having rubber-like properties in terms of extensibility and elastic recovery. See *Condensed Chemical Dictionary* (9th edition 1977), page 335, which defines the term "elastomer".

As used herein, the term "latex" refers to both hydrophobic latexes (emulsion-form) of the type well-known in the art, as well as latexes whose surfaces have been rendered hydrophilic in the manner described more fully hereinafter.

As used herein, the term "fibrous pulp" includes macerated slurries of fibers of the type well-known in the papermaking and nonwoven fabrics art. Such materials include, by way of example, cellulosic pulps such as NSK (Northern Softwood Kraft), SSK (Southern Softwood Kraft), and the like, cotton linters, polyolefins, polyesters, polyamides, and mixtures thereof. Cellulosic pulps are preferred.

As used herein, the term "wicking fibrous pulp" means pulps whose fibers wick, swell and absorb water. Preferred among such pulps are cellulosic pulps such as SSK, NSK, cotton linters, aspen pulps, and the like.

As used herein, the term "comprising" means various components can be conjointly employed in the latex compositions of the present invention. Accordingly, the term "comprising" encompasses the more restrictive terms "consisting essentially of" and "consisting of".

All percentages, ratios and proportions herein are by weight, unless otherwise specified.

B. Latex Compositions

The latex compositions used in the present invention basically comprise: (1) a liquid phase; and (2) particles dispersed in the liquid phase as a colloidally stable suspension. The liquid phase can be selected from water (aqueous), water-miscible solvents, and mixtures of water with these water-miscible solvents. Suitable water-miscible solvents include $C_1$–$C_3$ alcohols such as methyl alcohol, ethyl alcohol and isopropyl alcohol, ketones such as acetone, and other water-miscible solvents well known, for example, in the paint formulator's art. An aqueous (water) phase is typically preferred for the liquid phase.

The functional component of the latex composition is the particulate latex material dispersed in the aqueous phase. These latex particles are generally spherical in shape and are typically monodisperse in size, i.e. the particles sizes fall within a narrow range. These particles can sometimes be as large as several microns or as small as 10 nm. However, because the latex particles are typically formed by emulsion polymerization, these particles tend to be mainly submicron in size. Typically, the particle diameter of these latex particles is in the range of from about 0.1 to about 2.5 micrometer.

Hydrophobic latex particles comprise only an elastomeric core. Surface-modified hydrophilic latex particles are comprised of both the elastomeric hydrophobic core with an outer hydrophilic shell which is bound to the elastomeric core. The hydrophilic shell needs to be sufficiently integral with the core that the subsequently formed elastomeric film has a substantially permanent hydrophilic surface.

The elastomeric hydrophobic core in both types of latex is based on a polymer formed from a monomer, typically in combination with other comonomers to impart properties such as stiffness, strength, resistance to flowability at elevated temperatures, etc. The polymers which form the elastomeric core usually have glass transition ($T_g$) values of about 35° C. or less. Preferred polymers for elastomeric cores usually have $T_g$ values of about −10° C. or less.

The hydrophilic shell in the surface-modified latexes is the primary functional component of this type of latex particle. This shell has two functions. First, the hydrophilic surface colloidally stabilizes the latex particles in the liquid phase, thereby preventing flocculation. The second function of this shell is to provide surface hydrophilicity of the elastomeric film which forms when the liquid phase is removed. With cationic shells, a third function is notable, i.e., the propensity of the cationic species to attach the latex particles to anionically-charged surfaces of fibers, especially cellulose. This attachment propensity is used to advantage in one aspect of the present invention.

The latex particles are dispersed in the aqueous phase in an effective amount. What is "an effective amount" of latex particles depends upon the particular use of the latex composition, the manner in which it is formed, and like factors. Latex compositions used in the present invention usually comprise up to about 60% by weight latex particles on a solids basis. Typically, the latex particles comprise from about 5% to about 25% by weight of the latex composition on a solids basis. These matters may be adjusted at the discretion of the formulator.

In use, these latex particles form an elastomeric film having a hydrophilic surface when the liquid phase is removed. The process by which these particles form the elastomeric film is called "sintering". During sintering, the particles coalesce as the liquid phase is removed. These coalesced particles eventually form a continuous film (sinter) which has a substantially uniform hydrophilic exterior surface.

A detailed description of the preparation of the latexes herein follows. In general, the preparation comprises an emulsion polymerization process whereby polymerizable monomers such as styrene, butadiene, divinylbenzene, or the like, or mixtures thereof, are polymerized. When surface hydrophilic latexes are being prepared, the emulsion is carried out in the presence of diblock co-oligomer ingredient (LX, LQ, or mixtures thereof). The diblock co-oligomer ingredient comprises a tail group (L) which becomes involved in the polymerization reaction, and a head group (X or Q) which has hydrophilic characteristics. For example, the tail group can contain unsaturated bonds, e.g., an oleyl group; and the hydrophilic head can be a group X such as polyoxyethylene or group Q, which can be, for example, polyoxyethylene end-capped with a quaternary ammonium substituent. During the polymerization reaction a portion of the diblock is linked into the rubbery emulsion particles by its tail group, and the hydrophilic heads become arrayed on the surfaces of the emulsion particles, thereby rendering what would normally be substantially hydrophobic rubbery emulsion particles into particles whose surfaces are hydrophilic.

The following illustrates the preparation of cationic and nonionic end-capped diblock materials used in the preparation of surface-hydrophilic latexes for use in the practice of this invention.

Preparation of Cationic End-capped Diblock

The general reaction sequence for the synthesis of cationic diblock materials LQ used herein involves preparing the tosylate derivative (2) of the LX ethoxylate (1), followed by amination to form amine (3) and reaction with an alkyl halide to form the quaternized end-capping group (4), according to the following reaction sequence:

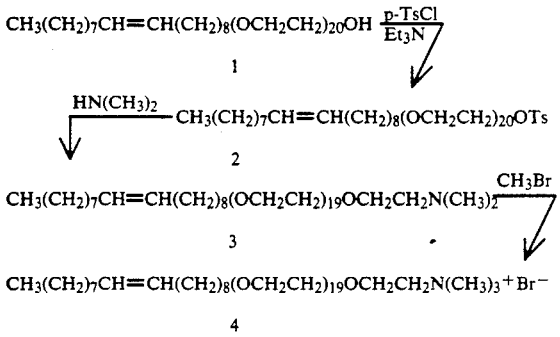

A typical synthesis is as follows:

Preparation of Oleyl($EO_{19}$)$OCH_2CH_2N(CH_3)_3{}^+Br^-$ A recrystallized sample of p-toluenesulfonyl chloride (550 g; 2.9 moles) was added in two batches (20 min apart) to a solution of 3.0 kg (2.6 mole) of oleyl ethoxylate and 871 g (8.61 mole) of triethylamine in 10 L of acetonitrile under an argon atmosphere at room temperature (25°-30° C.). The mixture was stirred for three days at room temperature and then was filtered and concentrated. Three liters of water were added and the mixture was extracted three times with methylene chloride. The organic layers were combined, dried, filtered and concentrated yielding 3336 g of a viscous oil, oleyl ($EO_{19}$)$CH_2CH_2OTs$: 1H NMR 7.8 (d, Ar), 7.4 (d, Ar), 5.3 (t, =CH), 3.4-3.9 (m, $OCH_2$), 2.4 (s, $ArCH_3$), 2.0 (m, $=CCH_2$), 0.9-1.6 (m, $CH_3CH_2$). The oil was taken up in 1 gal of acetonitrile and 1654 mL of condensed dimethylamine was added. The mixture was stirred overnight at room temperature and then the excess amine and acetonitrile were removed under a vacuum. While the mixture was heated with a hot water bath, 3 L of 5% sodium hydroxide were added and the mixture was extracted with methylene chloride. The organic layers were combined, dried, filtered and evaporated yielding 2305 g of oleyl ($EO_{19}$)$CH_2CH_2N(CH_3)_2$: 1H NMR 5.3 (t, =CH), 3.4-3.9 (m, $OCH_2$, 2.5 (t, $NCH_2$), 2.3 (s, $NCH_3$, 2.0 (m, =CCH), 0.9-1.6 (m, $CH_3CH_2$). The oleyl ($EO_{19}$)$OCH_2CH_2N(CH_3)_2$ was dissolved in 1 gal of acetonitrile and then methyl bromide was bubbled into the solution which was initially at room temperature. The temperature rose to 48° C. The addition was continued for 2.5 h until the excess methyl bromide began refluxing. The mixture was stirred for 3 h at room temperature and then concentrated. A $^{13}C$ NMR analysis indicated that up to 5% of the amine remained unreacted. The crude product was redissolved in 4 L of acetonitrile and methyl bromide was bubbled into the solution for 45 min. 50 mL of 10% sodium carbonate was added and the mixture was stirred at 40° C. overnight. The mixture was then filtered and concentrated yielding 2439 g of oleyl ($EO_{19}$)$OCH_2CH_2N(CH_3)_3{}^+Br^-$: 1H NMR 5.3 (t, =CH), 3.4-3.0 (m, $OCH_2$), 3.45 (s, $N^+CH_3$), 2.0 ($=CCH_2$). 0.9-1.6 (m, $CH_3CH_2$). By negative cationic titration, Total Cationic=87.5% [$N^+(CH_3)_3$ plus $N^+H(CH_3)_2$] and Quaternary=82.2% [$N^+(CH_3)_3$ only].

Nonionic End-capped Diblock

It will be appreciated that the nonionic materials (LX) which may be used as the nonionic diblocks herein, and which are used in the synthesis of the above-noted cationic end-capped diblock materials, comprise typical ethoxylated alcohol derivatives of alkenyl and/or polyunsaturated hydrocarbyl groups, generally in the chain length range of from about 10 to about 22 carbon atoms and include, for example, hydrocarbyl groups derivable from such materials as oleic acid, linoleic acid, linolenic acid, eleostearic acid, parinaric acid, and the like. Other unsaturated groups include oligomeric and polymeric materials having residual double bonds, including polybutadiene mixtures, polyisoprene mixtures, and the like. The oleyl group is a preferred unsaturated hydrocarbyl group in the nonionic diblock materials herein.

The polyoxyalkylene substituents on LX are of the formula $(OCH_2CH_2)_n$—OH, where n is an integer from about 5 to about 50, preferably from about 10 to about 20. It will be readily appreciated by those skilled in the emulsifier arts that these nonionic materials fall within the class of well-known ethoxylated alcohol nonionic surfactants, with the proviso that the hydrocarbyl substituent have one or more points of unsaturation which allow the material to become involved in the polymerization process, thereby chemically bonding the material to the latex particles. A commercially available material of this type is available under the trade name "VOLPO-20" (Croda, Inc. 183 Madison Ave., New York, N.Y. 10016), which comprises an oleyl group and an average of 20 ethoxylate units.

C. Preparation of Individual and Mixed Furnishes

Preparation of the latex-treated furnish (A) herein comprises, as an overall proposition, contacting an aqueous slurry of fibers with an emulsion of the latex particles in such manner so as to assure that the latex is deposited onto the fiber surfaces. In the case of anionic and nonionic latexes, the aqueous slurry of the fibers and the latex emulsion are combined and stirred to ensure homogeneity, and thereafter dried to establish the latex particles on the fiber surfaces. With cationic latexes, the drying step can, optionally, be omitted, inasmuch as the cationic latexes tend to self-adhere to the fibers, especially to anionically-charged fibers such as cellulose.

Typical preparations of the (A) furnishes herein comprise preparing a pulp slurry, generally containing from 0.1% to 5%, preferably 2% to 3%, by weight of fibers. The overall slurry will contain on the order of 95-99% water. To this fiber slurry is added, preferably continuously or portion-wise with vigorous stirring, the emulsion of latex particles. In general, the latex emulsions will comprise about 10% to 20% by weight (solids basis) of the latex particles suspended in water.

In general, it is preferred that the concentration of latex particles present in furnish (A) (taken on dry basis) is from about 0.5% to about 50%, preferably 1% to about 10%, by weight of the fibers being treated.

Heating (except for the drying step) is not necessary, but can optionally be employed. In general, the mixing step used in the preparation of the latex-treated furnish (A) is carried out at room temperatures.

The pH is not particularly critical and, generally, pH's in the range from about 3 to about 9 are satisfactory. For the cationic latexes, the preferred pH range is 4–6.

After the latex emulsion and pulp slurry are thoroughly mixed, (except, as noted above, for the cationic latexes or anionic latexes with deposition aids) the furnish is dried using a combination of filtration (to remove excess water) and heat. The latex particles are rather firmly adhered to the surfaces of the pulp fibers.

Preparation of the wicking pulp furnish (B) employs techniques which are well-known from the papermaking arts. For example, cellulosic fibers, usually chemically-digested in aqueous base, are thoroughly beaten and mixed into a water slurry. Pulp levels of from about 0.1% to about 5%, preferably 2% to about 3%, in this aqueous slurry are typical.

Following the separate preparation of pulps (A) and (B), the "mixed" furnish is prepared. In this step, pulps (A) and (B) are combined, in an aqueous milieu, generally by adding pulp (A) to pulp (B) in a continuous process using high speed mixing to ensure homogeneity of the resulting mixed pulp.

The resulting aqueous slurry of mixed pulp will typically contain from about 10% to about 50% by weight of pulp (A) and from about 50% to about 90% of pulp (B). Following admixture, the water content of the mixed pulp can be adjusted so that the viscosity of the overall mix furnish is suitable for pumping or spraying in the subsequent sheet-laying process.

As an additional feature of the present invention, wicking pulp (B) can also be treated with various commercial additives, particularly cationic wet-strength additives such as KYMENE (marketed as Kymene-557 by Hercules, Inc.). KYMENE- treated wicking pulps are particularly useful in conjunction with latex pulps (A) which have been prepared from non-cationic latexes, since sheet strength is enhanced considerably.

D. Laying of Furnishes to Form Sheets

Once the mixed furnish comprising pulps (A) plus (B) is prepared in the foregoing manner, it is used to prepare wet-laid sheets using processes of the type well-known in the papermaking art. See, for example, processes for making paper and sheets as disclosed in U.S. Pat. Nos. 3,301,746, to Sanford et al, Jan. 31, 1967; 3,905,863, Sep. 16, 1975 and 3,974,025, Aug. 10, 1976, both to Ayers; and the U.S. Pat. Nos. to Trokhan in 1980, numbers 4,191,609 and 4,239,065, all incorporated herein by reference. Indeed, one of the major advantages of the present process is that the mixed furnishes can be used with currently-available machinery and plant.

The following examples illustrate the preparation of surface-hydrophilic latexes for use in the practice of the present invention.

EXAMPLE I

A wet-end-depositable cationic latex based on styrene-butadiene rubber was prepared in the following manner. A mixture of a surfactant solution prepared by dissolving 6.44 g of oleyl ethoxylate having approximately 20 ethoxylate units in 500 mL of distilled water, another surfactant solution prepared by dissolving 2.15 g of derivatized oleyl ethoxylate having approximately 20 ethoxylate units with a quaternary ammonium functional group attached to the terminal end of the ethoxylate chain in 150 mL of distilled water, an initiator solution prepared by dissolving 0.72 g of 2,2'-azobis(2-amidinopropane) dihydrochloride in 50 mL of distilled water, and additional 301 mL of distilled water was placed in a 2 L stainless steel high-pressure reactor equipped with a mechanical stirrer. The distilled water used in this reaction was purged with argon before being used, and the reactor was flushed with nitrogen gas before the solution mixture was placed inside. The reactor containing the solution mixture was further purged with argon gas for one hour, then 0.72 g of divinylbenzene and 57.2 g of styrene were injected into the reactor. The transfer of 85.8 g of 1,3-butadiene into the reactor was carried out by condensing it in a 100 mL graduated cylinder first and then injecting the condensate. The reactor was sealed and the reaction mixture was heated to 60° C. and maintained at the constant temperature throughout the reaction with slow agitation with the mechanical stirrer for 18 hours to complete the emulsion polymerization.

A solid content of the latex product was estimated by the following method. Approximately 2 mL of the latex was dried in an oven at 110° C. for at least one hour. From the weight of this sample before and after drying, the solid content of the latex was calculated to be 13.1%. The particle size (diameter) of the latex measured by quasi-elastic light scattering was 0.154±0.036 μm.

The wet-end depositability of the cationic latex onto the surface of wood pulp was verified in the following manner. A mixture of the cationic latex and a refined Krafft pulp suspension in water with 0.1% consistency by weight was prepared such that the dry-weight ratio between the pulp and latex became about 5:1. Using sulfuric acid, the pH of the mixture was adjusted to 4.5. The turbidity of the mixture decreased quickly and became clear within 30 minutes under gentle agitation at room temperature. Observation of pulp under a microscope confirmed that latex particles were deposited onto the surface of pulp fibers.

EXAMPLE II

A wet-end-depositable cationic latex based on styrene-butadiene rubber was prepared in the manner similar to Example I. A reaction mixture having identical compositions described in Example I except without the addition of divinylbenzene was placed in a sealed 2 L stainless steel high-pressure reactor equipped with a mechanical stirrer. The mixture was then heated to 60° C. and maintained at the temperature 47 hours with slow agitation to complete the emulsion polymerization. A latex containing 12.3% solids by weight, determined by the method described in Example I, was obtained.

EXAMPLE III

A wet-end-depositable cationic latex based on styrene-butadiene-acrylic acid copolymer rubber was prepared in the following manner. A mixture of a surfactant solution prepared by dissolving 0.32 g of oleyl ethoxylate having approximately 20 ethoxylate units in 15 mL of distilled water, another surfactant solution prepared by dissolving 0.105 g of derivatized oleyl ethoxylate having approximately 20 ethoxylate units with a quaternary (trimethyl) ammonium functional group attached to the terminal end of ethoxylate chain in 15 mL of distilled water, an initiator solution prepared by dissolving 0.142 g of 2,2'-azobis(2-amidinopropane) dihydrochloride in 15 mL of distilled water, and additional 11.4 mL of distilled water was placed in a 250 mL thick-walled glass reaction bottle with a magnetic stirring rod. The distilled water used in this reaction was purged with argon for 15 minutes before being used. The reaction bottle containing the solution mixture of surfactants and initiator was flushed with nitrogen and sealed with a rubber gasket which was covered with a metal bottle cap with two holes. The transfer of 0.53 g of acrylic acid, 0.073 g of divinylbenzene, and 1.75 g of styrene into the reaction bottle was made by injecting the monomers through the rubber gasket with a syringe. The transfer of 5.25 g of 1,3-butadiene was made by condensing it first in a 15 mL graduated cylinder submerged in dry ice and injecting the condensate into the reaction bottle with a syringe. The reaction bottle was then placed in an oil bath set at 60° C. throughout the reaction period with slow agitation of the reaction mixture with a magnetic stirrer for 16 hours to complete the emulsion polymerization. A latex having a solid content of 10.4% was obtained. The wet-end depositability of the latex was verified by the method described in Example I.

EXAMPLE IV

A wet-end-depositable cationic latex based on styrene-butadiene rubber synthesized with anionic free radical initiator was prepared in the manner similar to Example III. A solution mixture prepared by dissolving 0.28 g of oleyl ethoxylate surfactant having approximately 20 ethoxylate units, 0.07 g of derivatized oleyl ethoxylate surfactant having approximately 20 ethoxylate units with a quaternary ammonium functional group attached to the terminal end of ethoxylate chain, and 0.035 g of potassium persulfate free-radical initiator in 56.4 mL of distilled water was placed in a 250 mL thick-walled glass reaction bottle with a magnetic stirring rod. The distilled water was purged with argon for 15 minutes before being used. The reaction bottle containing the solution mixture of surfactants and initiator was flushed with nitrogen and sealed with a rubber gasket covered with a metal cap and two holes. The transfer of 1.75 g of styrene and 5.25 g of 1,3-butadiene into the reaction bottle was carried out with a syringe as described in Example III. The reaction bottle was placed in an oil bath set at 60° C. throughout the reaction period with slow agitation of the reaction mixture with a magnetic stirrer for 16 hours to complete the emulsion polymerization. The solid content of the latex determined by the method described in Example I was 7.6%.

EXAMPLE V

A wet-end-depositable cationic latex based on styrene-butadiene rubber synthesized in the presence of cationic surfactant was prepared in the manner similar to Example III. A solution mixture prepared by dissolving 0.105 g of derivatized oleyl ethoxylate surfactant having approximately 20 ethoxylate units with a quaternary ammonium functional group attached to the terminal end of ethoxylate chain and 0.035 g of 2,2'-azobis(2-amidinopropane) dihydrochloride free-radical initiator in 49 mL of distilled water was placed in a 250 mL thick-walled glass reaction bottle with a magnetic stirring rod. The distilled water was purged with argon before being used. The reaction bottle containing the solution mixture of surfactant and initiator was sealed with a rubber gasket covered with a metal cap with two holes. The transfer of 2.8 g of styrene, 4.2 g of 1,3-butadiene, and 0.035 g of divinylbenzene was carried out with a syringe as described in Example III. The reaction bottle was placed in an oil bath set at 60° C. throughout the reaction period with slow agitation of the reaction mixture with a magnetic stirrer for 17 hours to complete the emulsion polymerization.

The solid content of the latex determined by the method described in Example I was 12.5%. The wet-end depositability of the latex onto the surface of wood pulp was verified.

EXAMPLE VI

The applicability of a cationic latex as a wet-end additive for a continuous papermaking process was demonstrated in the following manner. Approximately 500 dry pounds of refined northern softwood Kraft pulp was dispersed in water at the consistency of about 2.5% and kept in a stirred holding tank. The pH of pulp mixture was adjusted to 4.5 with sulfuric acid. About 100 gal. of cationic latex prepared according to a recipe similar to that described in Example I was added to the pulp to achieve the wet-end deposition of the binder. The extent of the deposition process was determined by centrifuging samples obtained from the pulp mixture and checking the turbidity of the supernatant. The turbidity due to the undeposited latex particles disappeared within 30 minutes.

The latex content of the final paper products prepared with the latex can be measured by x-ray fluorescence analysis. The analysis is done by brominating the unsaturated double bonds of a styrene-butadiene rubber component of the latex and then measuring the x-ray fluorescence intensity.

EXAMPLE VII

A nonionic surface-hydrophilic elastomer latex based on styrene-butadiene rubber was prepared in the following manner. A mixture of a surfactant solution prepared by dissolving 0.28 g of oleyl ethoxylate having approximately 20 ethoxylate units ("VOLPO-20") in 20 mL of distilled water, an initiator solution prepared by dissolving 0.035 g of potassium persulfate in 20 mL of distilled water, and an additional 16.4 mL of distilled water were placed in a 250 mL thick-walled glass reaction bottle with a magnetic stirring rod. The distilled water used in this reaction was purged with argon for 15 minutes before being used. The reaction bottle containing the solution mixture of surfactant and initiator was purged with argon for 20 minutes and sealed with a rubber gasket which was covered with a metal bottle cap with two holes. The transfer of 1.75 g of styrene into the reaction bottle was made by injecting the monomers through the rubber gasket using a syringe. In a similar manner, the transfer of 5.25 g of 1,3-butadiene was made by condensing it first in a 15 mL graduated cylinder submerged in dry ice and injecting the condensate into the reaction bottle with a syringe. The reaction bottle was then placed in an oil bath set at 60° C. throughout the reaction period with slow agitation of the reaction mixture with a magnetic stirrer for 16 hours to complete the emulsion polymerization.

Approximately 2 mL of the latex product was dried in an oven at 110° C. for at least one hour. From the weight before and after the drying, the solid content of the latex was estimated to be 9.5%.

EXAMPLE VIII

A nonionic surface-hydrophilic elastomer latex based on styrene-butadiene-acrylic acid copolymer was prepared in the following manner. A mixture of a surfactant solution prepared by dissolving 0.32 g of oleyl ethoxylate having approximately 20 ethoxylate units in 15 mL of distilled water, an initiator solution prepared by dissolving 0.142 g of potassium persulfate in 15 mL of distilled water, and additional 26.4 mL of distilled water were placed in a 250-mL thick-walled glass reaction bottle with a magnetic stirring rod. The distilled water used in this reaction was purged with argon for 15 minutes before being used. The reaction bottle containing the solution mixture of surfactant and initiator was purged with argon for 30 minutes and sealed with a rubber gasket and a metal bottle cap with two holes. The transfer of 0.07 g of divinylbenzene, 0.526 g of acrylic acid, and 1.75 g of styrene into the reaction bottle was made by injecting through the rubber gasket with a syringe. The transfer of 5.25 g of 1,3-butadiene was made by condensing it first in a 12 mL graduated cylinder submerged in dry ice and injecting the condensate into the reaction bottle with a syringe. The reaction bottle was then placed in an oil bath set at 60° C. throughout the reaction period with slow agitation of the reaction mixture with a magnetic stirrer for 16 hours to complete the emulsion polymerization. Thus a latex having solid content of 7.1% by weight, which was measured by the method described in Example VI, was obtained.

EXAMPLE IX

A nonionic surface-hydrophilic elastomer latex containing butadiene-ethylene oxide diblock co-oligomer was prepared in the following manner. A 250 mL round bottom flask was flushed with nitrogen for 30 minutes and then submerged in a dry ice-acetone bath. The transfer of 3.1 g of liquid 1,3-butadiene to the reaction vessel was made after it had been condensed in a 25 mL flask containing calcium hydride and stirred for 3 hours. A solution prepared from 0.033 g of butadiene-ethylene oxide diblock co-oligomer, which had an average molecular weight of 1,845 measured by vapor-phase osmometry and molecular-weight ratio of 2.85 between the ethylene oxide oligomeric segment and butadiene oligomeric segment, dissolved in 15 mL of distilled water, one mL of 1-dodecanemercaptan, an initiator solution prepared by dissolving 0.096 g of potassium persulfate dissolved in 10 mL of distilled water, and additional 5 mL of distilled water were added to the reaction vessel. The water used in this work was freshly distilled just before being used. The flask containing the reaction mixture was sealed, removed from the dry ice-acetone bath, and allowed to warm up until the contents of the flask were melted. The reaction vessel was then heated in an oil bath to about 53° C. and maintained at constant temperature with slow agitation using a magnetic stirrer for 64 hours to complete the emulsion polymerization.

EXAMPLE X

A nonionic surface-hydrophilic elastomer latex which, even after extensive dialysis, was capable of producing rubbery films having a hydrophilic surface was prepared in the following manner. A 500 mL round bottom flask was flushed with nitrogen gas for 15 minutes and then cooled by submerging in a dry ice-acetone bath. A mixture of 15 g of condensed 1,3-butadiene, 5 g of styrene, 0.4 g of 1-dodecanethiol, a surfactant solution prepared by dissolving 0.8 g of oleyl ethoxylate having approximately 20 ethoxylate units in 40 mL of distilled water, an initiator solution prepared by dissolving 0.4 g of potassium persulfate in 40 mL of distilled water, and an additional 100 mL of distilled water was placed in the reaction vessel. The distilled water used in this reaction was purged with argon for 15 minutes before being used. The flask containing the reaction mixture was sealed, removed from the dry ice-acetone bath, and allowed to warm up until the contents of flask were melted. The reaction vessel was submerged in an oil bath set at 65° C. for 20 hours to complete the emulsion polymerization. A latex having a solid content of 10.5% was obtained.

EXAMPLE XI

A nonionic surface-hydrophilic elastomer latex capable of producing rubbery films, which could maintain stable hydrophilic surface even after being washed with water for many hours, was prepared in the following manner. A mixture of 2.5 g of 1,3-butadiene, 2.5 g of styrene, 0.0845 g of 1-dodecanethiol, 0.2 g of oleyl ethoxylate having approximately 20 ethoxylate units, 0.1 g of potassium persulfate, and 45 mL of distilled and argon-purged water was placed in a 250-mL flask, and emulsion polymerization was carried out as described in Example IV. A latex having a solid content of 10.7% was obtained.

As can be seen from the foregoing Examples, the emulsion polymerization process used herein employs reaction conditions typical of the art, with the major exception that the participating diblock material is present in the reaction mixture. Generally, a temperature of about 50° C. is sufficient to emulsion polymerization of the polymerizable component at a reasonable rate. Such temperatures also ensure that the amphiphilic diblock emulsifier is incorporated into the elastomeric particles without the need of any additional cross-linking monomer such as divinylbenzene. Typically, the temperature used for emulsion polymerization ranges from about 60° C. to about 65° C. Emulsion polymerization is carried out for a sufficient time to ensure formation of the latex composition; e.g. from about 8 to about 64 hours. While emulsion polymerization as described herein forms aqueous latex compositions, latexes involving other water-miscible solvents as the liquid phase can be formed by solvent exchange.

Optionally, initiators other than those exemplified may be used, but such matters are within the knowledge of those skilled in the latex polymerization art and need not be described in detail, herein.

Another, but less preferred, method for preparing latex compositions of the present invention is by surface grafting an amphiphilic diblock material onto elastomeric particles present in a preformed latex. Such preformed latexes are commercially available or else can be synthesized by standard emulsion polymerization techniques. See U.S. Pat. No. 3,397,165 to Goodman et al, issued Aug. 13, 1968, which discloses the preparation of an aqueous latex of butadiene polymer by emulsion polymerization using a seed latex. See also U.S. Pat. No. 3,575,913 to Meier, issued Apr. 20, 1971, which discloses the preparation of latexes such as those formed by polymerizing itaconic acid, styrene and butadiene by the "shot growth" technique.

Suitable amphiphilic diblock materials include those previously defined for use in the emulsion polymerization process for making latex compositions of the present invention. Typically, the diblock material is used in an amount of from about 2 to about 20% by weight of the preformed latex.

In order to cause surface grafting of the amphiphilic diblock onto the latex particles of the preformed latex, a free-radical initiator is used. Suitable free-radical initiators can be water-soluble or oil-soluble. Representative examples of oil-soluble free-radical initiators include azobisisobutyronitrile (AIBN), dimethyl azobisisobutyronitrile,1,4-diazobiscyclo(2.2.2) octane, and the like. The free-radical initiator is used in an amount effective to cause surface grafting of the amphiphilic diblock material onto the elastomeric particles present in the preformed latex, e.g. from about 0.1 to about 1% by weight of latex solids.

Surface grafting of the amphiphilic diblock material onto the latex particles of the preformed latex is typically carried out at a temperature of at least about 50° C. Preferred temperatures for surface grafting are from about 60° to about 65° C. The mixture of preformed latex, amphiphilic diblock material and free-radical initiator is heated to the appropriate temperature for a period of time sufficient to ensure surface grafting of the amphiphilic diblock material onto the latex particles of the preformed latex. Aqueous latex compositions formed by surface grafting can be converted to water-miscible solvent (alcohol) latexes by solvent exchange techniques.

The following Example illustrates a typical, routine method of preparing hydrophobic latexes which can be used herein.

EXAMPLE XII

A styrene-butadiene rubber latex is prepared as follows. A comonomer mixture consisting of 15 g of condensed 1,3-butadiene and 5 g of styrene is dispersed and polymerized in 180 mL of distilled water with 2.8 g of sodium lauryl sulfate emulsifier, 0.4 g of potassium persulfate initiator, and 0.4 g of 1-dodecanol chain transfer agent. A latex having a solid content of 11.0% is obtained.

The following examples illustrate handsheet production in the manner of the present invention. In the examples, "NSK" refers to Northern Softwood Kraft pulp and "SSK" refers to Southern Softwood Kraft pulp.

EXAMPLE XIII

Type A Pulp Slurry—1.0638 g of NSK pulp (1.00 dry) are dispersed in 800 ml of tap distilled $H_2O$. The pH is adjusted to 3.5 with 0.5N HCl. The pulp slurry is heated to 60° C. with stirring. To this slurry is added 1.44 gms of cationic latex (10.4% solids) of the type prepared in Example I. This amounts to a 15.0% latex solids deposition based on dry pulp weight. The 1.00 gms dry weight amounts to 40% of NSK pulp treated with cationic latex in a 2.5 g handsheet.

Type B Pulp Slurry—1.60 g of NSK pulp (1.5 dry weight) which equals 60% of a 2.5 g handsheet—are dispersed in 1000 ml of distilled $H_2O$. The pH is adjusted to 3.5 with 0.5N HCl.

To the B slurry is added the A slurry with stirring for ~5 minutes at R. T. (~24° C.).

The combined slurries (A+B) are poured into a pilot plant Deckle Box and dispersed in the water. A 2.5 g handsheet is formed. The excess water is removed on the vacuum slit. The damp sheet is cut into quarters (~15 cm×15 cm). Each quarter is dried on a Carver press under pressure at 110° C. for 15 minutes. Before drying the sheets are placed between 25 mesh plastic screens, which are placed between polytetrafluoroethylene plates.

The resulting handsheets exhibit excellent dry- and wet-tensile strength, handle, as well as good burst strength and water drop sorption time.

EXAMPLE XIV

Type A Pulp Slurry—1.06 g of SSK pulp (1.00 dry) are dispersed in 800 ml of distilled $H_2O$. The pH is adjusted to 3.5 with 0.5N HCl. The pulp slurry is heated to 60° C. with stirring. To this slurry is added 1.44 g of cationic latex (10.4% solids) of the type prepared in Example III. This amounts to a 15.0% latex solids deposition based on dry pulp weight. The 1.00 dry weight amounts to 40% of NSK pulp treated with cationic latex in a 2.5 g handsheet.

Type B Pulp Slurry—1.60 g of SSK pulp (1.5 gms dry weight)—which equals 60% of a 2.5 g handsheet—are dispersed in 1000 ml of distilled $H_2O$. The pH is adjusted to 3.5 with 0.5N HCl.

To the B slurry is added the A slurry with stirring for ~5 minutes at R. T. (~24° C.).

The combined slurries (A+B) are poured into a pilot plant Deckle Box and dispersed in the water. A 2.5 g handsheet is formed. The excess water is removed on the vacuum slit. The damp sheet is cut into quarters (~15 cm×15 cm). Each quarter is dried on a Carver press under pressure at 110° C. for 15 minutes. Before drying the sheets are placed between 25 mesh plastic screens, which are placed between polytetrafluoroethylene plates.

The resulting handsheets exhibit excellent dry- and wet-tensile strength, handle, as well as good burst strength and water drop sorption time.

EXAMPLE XV

In this example, 2.5 g mixed furnish pulp (2.66 g moisture adjusted) is used to make a handsheet containing 20% of latex-treated pulp.

Using the technique of Example XIII, 0.5 g of NSK pulp is treated with a 20% cationic latex emulsion of the type disclosed in Example I, at pH 4.5; 60° C.; with stirring for 30 minutes.

2.0 g NSK pulp is separately dispersed in 100 ml $H_2O$—pH 4.5.

The treated latex-pulp slurry is cooled to ~30° C. before combining with the untreated pulp slurry. The mixed pulp is then stirred 5 minutes.

In the manner of Example XIII, a handsheet is made on the Deckle Box; excess $H_2O$ is removed on the vacuum slit. After pressing and heat-drying (110° C.), the resulting sheet is suitable for use as an absorbent facial tissue.

EXAMPLE XVI

Type A Pulp (Dried) 1.5 g of dry SSK pulp are dispersed in 800 ml of tap distilled $H_2O$. The pH is adjusted to 5.0 with 0.5 $NH_4Cl$. The pulp slurry is heated to 60° C. with stirring. To this slurry is added 1.4 gms of nonionic latex (10.5% solids) of the type prepared in Example XI. Stirring is continued for 30 minutes, after which excess water is removed by centrifugation, and the pulp fibers are dried with heat (110° C.).

Type B Pulp Slurry—2.6 g of NSK pulp (1.5 gms dry weight) are dispersed in 1000 ml of tap distilled $H_2O$. The pH is adjusted to 3.5 with 0.5N HCl. KYMENE (0.1% by weight of fibers) is added, and mixed thoroughly for 20 minutes.

Dry Pulp A is re-slurried in water (1.5 g/17 ml $H_2O$) by vigorous mixing. To the B slurry is added the A slurry with stirring for ~5 minutes at R. T. (~24° C.).

The combined slurries (A+B) are poured into a pilot plant Deckle Box and dispersed in the water. A towel-like paper product is formed. The excess water is removed on the vacuum slit. The damp sheet is dried on a Carver press under pressure at 110° C. for 15 minutes. Before drying the sheets are placed between 25 mesh plastic screens, which are placed between polytetrafluoroethylene plates.

The resulting "towel" exhibits excellent dry- and wet-tensile strength, handle, as well as good burst strength and water drop sorption time.

EXAMPLE XVII

The procedure of Example XVI is repeated without the latex of Example XI, but using the same amount (solids basis) of the latex of Example X, with similar results.

EXAMPLE XVIII

Type A Pulp Slurry—1.0 g of SSK pulp and 0.5 g polyolefin fibers (0.5–2 mm length) are dispersed in 800 ml of tap distilled $H_2O$. The pH is adjusted to 3.5 with 0.5N HCl. The pulp slurry is heated to 60° C. with stirring. To this slurry is added 1.4 gms of cationic latex (10.38% solids) of the type prepared in Example III.

Type B Pulp Slurry—1.65 g of NSK pulp are dispersed in 1000 ml of tap distilled $H_2O$. The pH is adjusted to 3.5 with 0.5N HCl.

To the B slurry is added the A slurry with stirring for ~5 minutes at R. T. (~24° C.).

The combined slurries (A+B) are poured into a pilot plant Deckle Box and dispersed in the water. A reinforced sheet is formed. The excess water is removed on the vacuum slit. The damp sheet is cut into quarters (~15 cm×15 cm). Each quarter is dried on a Carver press under pressure at 110° C. for 15 minutes. Before drying the sheets are placed between 25 mesh plastic screens, which are placed between polytetrafluoroethylene plates.

The resulting olefin fiber-reinforced "nonwoven" sheets exhibit excellent dry- and wet-tensile strength, handle, as well as good burst strength and water drop sorption time.

EXAMPLE XIX

The procedure of Example XVI is repeated, but with substitution of the hydrophobic latex of Example XII for the latex of Example XVI, with similar results.

The foregoing examples all illustrate the preparation of sheets from homogeneously mixed pulps. This invention also contemplates the use of latex-treated pulps to form layered structures, i.e., structures with alternate layers of latex-treated pulp and wicking pulp. Multilayer "sandwich" structures of this type are also contemplated. Example XX illustrates one such item.

EXAMPLE XX

Following the procedure of Example XVI, two pulp slurries of types A and B are prepared.

One-half the B slurry is poured into the Deckle Box and vacuum is applied until most of the water has passed through.

The A slurry is then poured evenly onto the B slurry, and vacuum again applied. This results in a bi-layer A-B structure.

The remainder of the B slurry is then added, with vacuum, to form a B-A-B "sandwich" structure.

After pressing and heat drying, the resulting structure is useful as an absorbent pad, bandage, or the like.

What is claimed is:

1. An absorbent structure, comprising an intimate wet-laid mixture of separately-prepared pulps A and B, wherein:

(i) from about 10% to about 50% by weight of said structure comprises fibrous cellulosic pulp (A) which is treated with latex particles, said latex particles being in the 0.1–2.5 micrometer size range and comprising a core which is a polymer selected from the group consisting of butadiene, isoprene, styrene and mixtures thereof, said core having an outer shell comprising moieties LQ, wherein L comprises a hydrophobic hydrocarbyl group containing one or more unsaturated bonds and Q is of the formula $$-(EO)_n-\overset{\overset{R^1}{|}}{\underset{\underset{R^3}{|}}{N^+}}-R^2$$

wherein $R^1$ and $R^2$ are each $C_1$ to $C_4$ alkyl or hydroxyalkyl, or together form a cyclic or heterocyclic ring, and $R^3$ is H or $C_1$–$C_4$ alkyl or hydroxyalkyl, and wherein n is an integer of from 5 to about 50, EO is ethylene oxide and n is an integer from about 5 to about 50; and (ii) from about 50% to about 90% by weight of untreated cellulose pulp (B).

* * * * *